US006298999B1

(12) United States Patent
Bellman

(10) Patent No.: US 6,298,999 B1
(45) Date of Patent: Oct. 9, 2001

(54) TIRE STORAGE RACK

(76) Inventor: Ricky B. Bellman, 243 Isleview Dr., Oswego, IL (US) 60543

( * ) Notice: Subject to any disclaimer, the term of this patent is extended or adjusted under 35 U.S.C. 154(b) by 0 days.

(21) Appl. No.: 09/654,575

(22) Filed: Sep. 1, 2000

(51) Int. Cl.[7] ..... A47F 7/00

(52) U.S. Cl. ..... 211/24; 211/49.1; 211/189; 108/55.1; 108/56.3; 108/57.22

(58) Field of Search ..... 211/23, 24, 194, 211/189, 49.1; 108/53.1, 55.1, 56.3, 57.17, 57.22, 57.31

(56) References Cited

U.S. PATENT DOCUMENTS 2,828,932 * 4/1958 De Pew et al. .
2,828,933 4/1958 De Pew et al. .
2,988,313 * 6/1961 Ellison .
3,159,116 * 12/1964 Skubic .
3,168,060 2/1965 Farley .
3,289,613 12/1966 Evans .
3,576,169 4/1971 Depew .
3,583,338 6/1971 Marcheso .
3,812,974 * 5/1974 Sylvester .
3,850,295 11/1974 Black .
3,853,072 12/1974 Skubic et al. .
3,855,944 12/1974 Skubic et al. .
4,043,462 8/1977 Schiron .
4,068,599 1/1978 Sapp et al. .
4,290,370 9/1981 Gallagher .
5,259,325 11/1993 Pilger .

* cited by examiner

*Primary Examiner*—Robert W. Gibson, Jr.
(74) *Attorney, Agent, or Firm*—Mathew R. P. Perrone, Jr.

(57) ABSTRACT

A improved storage rack for tires includes a pallet and frame assembly removably mounted on the pallet. The frame assembly uses a combination spring loading and clipping as a securing device for mounting on the pallet. Also, the frame assembly permits the pallets to be more easily stacked and unstacked.

7 Claims, 4 Drawing Sheets

TIRE STORAGE RACK

This invention relates to a tire storage rack, and more particularly to a tire storage rack capable of storing a larger number of tires in the same or a lesser amount of floor space.

BACKGROUND OF THE INVENTION

Storage space is always at a premium. Storage of tires is especially difficult. There must be an adequate number of warehouses to store the tires for delivery to the various retailers or commercial users while at the same time keeping the cost down. The storage space is expensive. It is desired to effectively use storage space, and thereby minimize, the cost of storing items in the storage space.

Typically, a tire warehouse is a huge building. Tires take up space. The tire warehouse or other building must have a sufficient height to accommodate such storage. This huge building makes it difficult to keep records and store the appropriate amount of tires in the appropriate place for the appropriate use at the appropriate time.

Currently, there is a limitation on the height of a stack of tires. The current storage racks do not maximize the use of the height of the warehouse. With this problem, the various solutions involved such building more warehouse space or stacking too many tires in the other warehouse serves to make recovery of desired tires difficult.

With warehousing of tires, not only must the tires be stored, but they must also be accessible. Any device, which can simplify this matter and permit the tires to be more accessible while in storage, provides great advantages.

When tires are stacked above a certain, separation sheets are required between each tire in the stack of tires. The sheet stabilizes stack, by preventing sliding or stacking between touching tires. Sticking renders it difficult to retrieve a tire. Sliding may cause the stack to fall.

Pallets are known to stabilize stacks of tires. However, the pallets of the prior art tend to create almost as many problems as they solve.

Typically, tires are stored on pallets with an X-shaped rack thereon to support the various tires. The X-shaped rack suffers from a variety of defects. The X-shaped rack limits the number of tires that can be stored on the pallet. The X-shaped rack is difficult to move and difficult to store. However, at the current time, the X-shaped rack is the state of the art.

Typically, this X-shaped rack must have the X-shaped frame nailed on the pallet, in order to support the tires thereon. This structure makes the pallet difficult to move and disassemble. Moving is required for stored tires. Disassembly is required to store pallets not in use.

Also, the height of the X-shaped tire storage rack limits the number of tires, which can be stored thereon. With the nailing of the X-shaped tire storage rack to the wood pallet, disassembly and reassembly of the frame becomes difficult. The nails always cause problems from a disposal standpoint. Great care must be taken in assembling and reassembling the tire storage racks so that the nails do not get lost or otherwise misused. Thus, this tire storage rack has a number of difficult problems.

Additionally, the X-shaped tire storage rack makes the storage of one pallet on another pallet of tires by stacking very difficult. Great skill is required from a forklift driver in stacking and unstacking pallets, which support tires.

With the consideration of FIG. 1 and FIG. 2, the X-shaped frame 108 of the prior art on a pallet 110 provides some storage. The X-shaped frame 108 is secured to pallet 110 by nails 112 through nailed foot 116. Slip sheet 114 between tires 106 is almost required in order to provide stability to the stack 104 of tires 106.

Removal of nails 112 is required to disassemble the X-shaped frame 108. Loss of nails 112, without proper disposal or recovery, creates a hazard anywhere, but especially in a workplace. With using and removing nails 112, damage to pallet 110 is almost inherent. Thus, the pallet 110 with the X-shaped frame 108 leaves a lot to be desired as a tire storage device.

Accordingly, it is very desirable to improve the storage of tires. Such an improvement can have a great economic value and improve safety.

SUMMARY OF THE INVENTION

Among the many objectives of this invention is the provision a tire storage rack having a pair of connected H-shaped frames on a pallet.

A further objective of this invention is the provision of a stackable tire storage rack.

Yet a further objective of this invention is the provision of a tire storage rack to eliminate separation sheets between tires.

A still further objective of this invention is the provision tire storage rack, which supports additional tires.

Another objective of this invention is the provision of a tire storage rack, which is easily assembled.

Yet another objective of this invention is the provision of a tire storage rack, which is easily disassembled.

Still, another objective of this invention is the provision of a tire storage rack, which is easily stored.

Also, an objective of this invention is the provision of an improved method of storing tires.

A further objective of this invention is the provision of a rack to permit tires to be easily recovered from storage.

Yet a further objective of this invention is the provision of a tire storage rack, which is easily movable in a storage facility.

Still a further objective of this invention is the provision of a tire storage rack, which more efficiently uses the height of the warehouse or other storage facility.

These and other objectives of the invention (which other objectives become clear by consideration of the specification, claims and drawings as a whole) are met by providing a method and improved storage for tires including a pallet and frame assembly removably mounted on the pallet.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
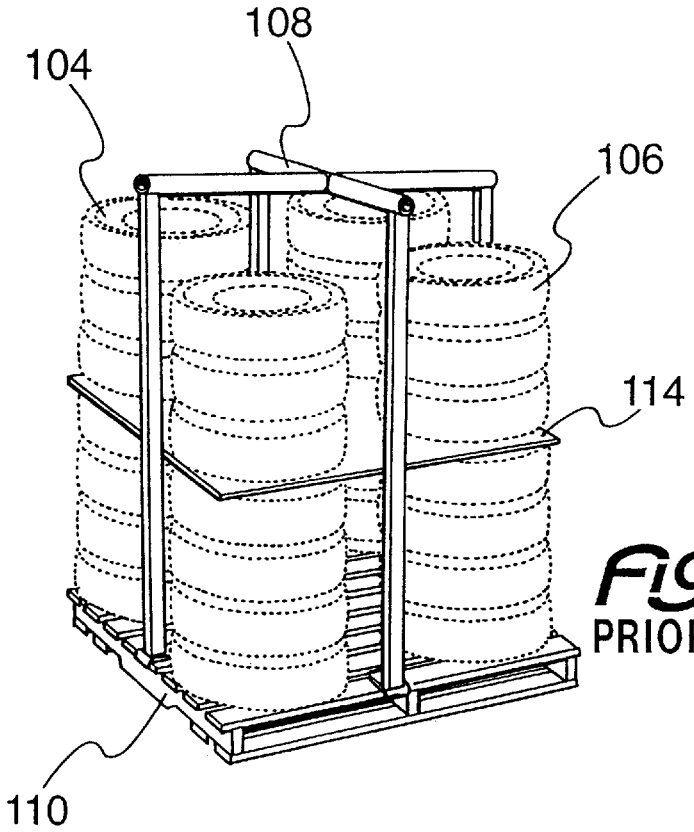
Fig. 1. PRIOR ART
FIG. 1 depicts an X-shaped frame 108 of the prior art on a pallet 110.
Figure 2:
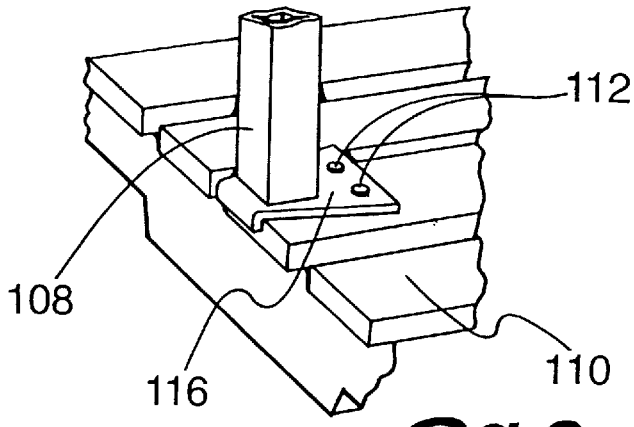
Fig. 2. PRIOR ART
FIG. 2 depicts a nailed foot 116 for X-shaped frame 108 of the prior art on a pallet 110.

The tire storage device of this invention includes a pallet with a pair of H-shaped frames connected by a bar. The H-shaped frames clip onto the pallet at the base clip. The base clip is a squared, U-shaped member, which fits easily over the pallet arms and permits the frame to be locked thereon.

With the prior art tire rack being about 125 centimeters (about 50 inches) tall, one embodiment of this invention has an overall height of about 150 centimeters (60 inches). A more preferred embodiment has an overall height of about 180 centimeters (72 inches).

The double goal post of the H-shaped frame, forming one embodiment of the tire storage rack, being connected on each end, permits storage of up to eleven more tires on each rack with an increase in height of about 25 centimeters. Thus, great advantages are obtained because the increase in tire storage capability results without a corresponding or proportional use of space.

More particularly, the frame has a first tall arm and a second tall arm. The frame is braced about two thirds of the way up the rack with another brace or bar being on top. The top bar clicks or snaps onto the opposing H-shaped frames at each end thereof. In this fashion, the entire frame cooperates with the pallet and becomes stronger.

Also, the side bar connecting the two H-shaped frames together clips onto the top of the frame. Such secure clipping mechanisms, without the use of nails, provide for an easily disassembled and reassembled rack. Thus, if storage for tire is needed, the rack can be easily reassembled and loaded. The support snaps onto the H-shaped frame. In this fashion, the frame is rendered stronger and more usable.

Additionally, the side bar connecting the two H-shaped frames together clips onto the top of the frame. Again, such clipping mechanisms provide for an easily disassembled and reassembled rack without the use of nails. Thus, if storage for tires is needed, the tire storage rack of this invention can be easily reassembled and loaded.

With the ladder frame of the most preferred rack, not only can the storage rack support double the number of automobile tires, it can alternatively support eight truck tires, instead of the standard six tires. The ladder frame thus provides a great increase in storage space with a minimal increase in height. Thus, the height of the warehouse can be used more efficiently.

In a preferred form of attaching either frame to the pallet, the yoke foot actually has a protruding edge from the base thereof. This protruding edge extends from the yoke foot base up to about 2.5 centimeters (about 0.9 inch). This protruding edge of the yoke foot base sticks out and extends toward the inside of the pallet, so, that when the yoke foot sits down on the frame, the protruding edge locks under the inside boards—the second board in on each side.

With the protrusion edge, along with the spring capability of the frame itself, it is unnecessary to nail the iron of the frame to the wood of the pallet anymore. That little protrusion edge sticks out about 2.5 centimeters each side on the inside of the frame at the foot and locks under the board. This edge combined with the spring loaded factor really locks the frame on the pallet securely. It is a matter of just pulling on the frame to get it off of the pallet. But since the frame locks itself in once it is put on the pallet, the combination of the spring and the protrusion edge eliminates the nailing requirement.

The two (2) additional bars going horizontal on the ladder frame side are actually going to be smaller and either rounded or squared but only about 2.54 centimeters (one inch) in diameter and are really for support for the passenger tires to be laced on the pallet. With automobile tires laced on the pallet, greater storage is achieved in the same floor space, without spacer sheets.

Instead of increasing a pallet quantity from 24 to 28 automobile tires on a prior art pallet to 35 tires per pallet for one embodiment of this invention, the preferred embodiment of this invention permits double the storage of automobile tires with about a fifty percent increase height. So the H-shaped frame and the ladder frame make better use of warehouse height.

The other good quality about the tire storage rack of this invention, especially the preferred embodiment, it is that it is a universal type pallet, that is one size fits all. Truck tires fit on this pallet. Automobile tires are laced on this pallet. Both types of tires work out very well.

With the ladder frame and the H-shaped frame, stacking of tire loaded pallets becomes easier. The framing is easier to sight and stack from a fork lift truck. Such assemblies are also easier to unstack and provide access to tires.

The various pieces of the support frame in this matter may be bolted, welded, snap-fitted, or otherwise secured together. The snap-fitted procedure is preferred, for ease of assembly and disassembly. Ease of assembly and disassembly is a major advantage of the tire storage rack 100.

Figure 3:
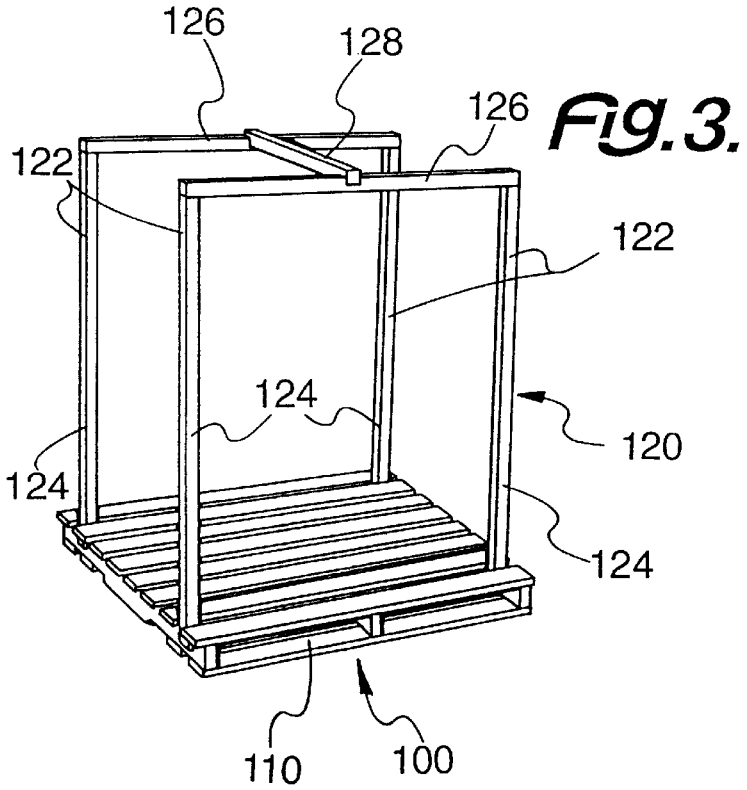
FIG. 3 depicts a perspective view of barred frame 120 for the tire storage rack 100 of this invention.

Referring now to FIG. 3, the barred frame 120 of the tire storage rack 100 is depicted. Bar assembly 122 of barred frame 120 is secured to pallet 110. Bar assembly 122 includes two side bars 124 connected by a top bar 126. Cross bar 128 interconnects top bars 126, in order to add strength to bar assembly 122. Between pallet 110 and the cross bar 128, a sturdy frame mounted on pallet 110 provides a tire storage rack 100 of this invention.

Figure 4:
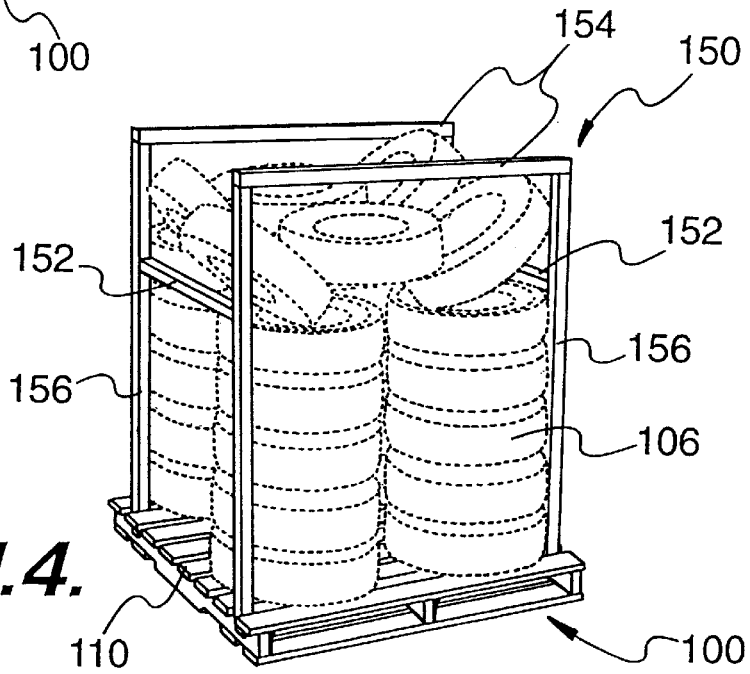
FIG. 4 depicts a perspective view of H-shaped frame 200 for the tire storage rack 100 of this invention.

Referring now to FIG. 4, an H-shaped frame 150 is depicted in combination with pallet 110, as a preferred version of tire storage rack 100. H-shaped frame 150 includes two goal post frames 152. Each goal post frame 152 is formed by a pair of lateral bars 156 secured to a cross bar. The H-shaped frame 150 or goal post shape provides the structure and support therefor. Connecting each goal post frame 152 is cross bar 154. With the cross bar 154 connecting each end of the goal post frame 152, a strong support for the frame 152 is accomplished.

By making a comparison between the prior art FIG. 1 with the X-shaped frame 108 and the H-shaped frame of FIG. 4, great advantages are seen. With no increase in floor space, and possibly a slight increase in height, up to thirty one tires can be stored on the pallet of FIG. 4 instead of the twenty eight tires of FIG. 1.

Figure 5:
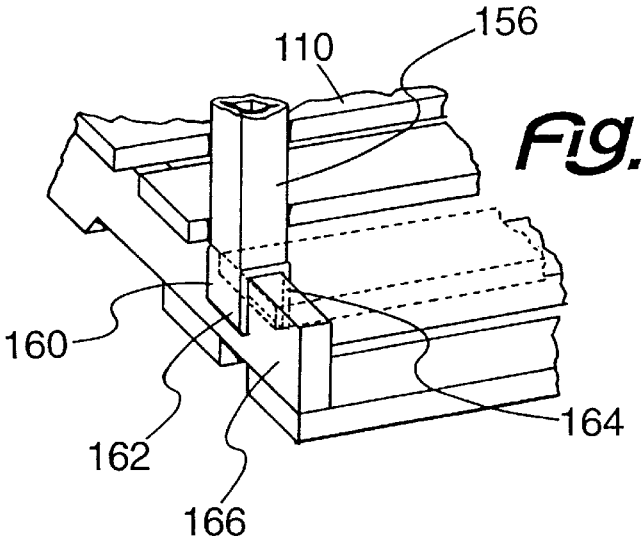
FIG. 5 depicts a perspective view of the yoke foot 160 for H-shaped frame 150.

Adding FIG. 5 to the consideration, at the base of either H-shaped frame 150 and specifically lateral bar 156 or barred frame 120 or side bar 124 is yoke foot 160. Yoke foot 160 is U shaped and has a first U-side 162 and a second U-side 164. Between the U-shaped member, that is yoke foot 160, may fit the pallet board 166.

Both yoke foot 160 on the lateral bar 156 or yoke foot 160 on the side bar 124, may have a temporary wider separation during attachment to pallet 110, as each yoke foot 160 is applied to pallet 110. After mounting on pallet 110, a spring-like action caused by the temporary widening helps support H-shaped frame 150 on pallet 110 by a spring-like action.

The yoke foot 160 is just wide enough to receive the pallet board in a clamping fashion. Referring back to FIG. 4, there is a spring type relation between cross bar 154 and each lateral bar 156 or each side bar 124 of FIG. 3. Thus, the spring like motion permits the yoke feet 160 to be separated and applied to the pallet or wood base 166. The spring like motion strengthens the hold of the H-shaped frame 150 on the pallet 110 and eliminates the necessity for nailing.

Figure 6:
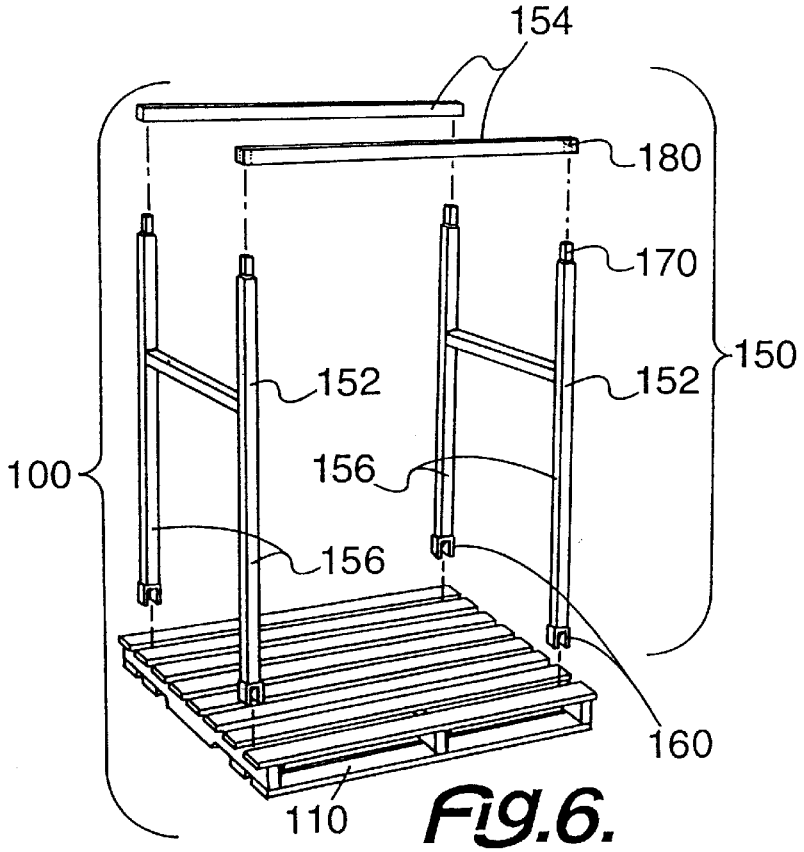
FIG. 6 depicts a perspective, exploded view of H-shaped frame 150 for the tire storage rack 100 of this invention.

Adding FIG. 6 to the consideration, on an opposing end of either side lateral bar 156 and oppositely disposed from yoke foot 160 is square plug 170. Square plug 170 is a male member adapted to be received by socket 180 in the cap cross bar 154. As cap cross bar 154 receives square plug 170 into socket 180, each H-shaped frame 150 is thus supported and rendered strong for the purpose of supporting the tires 106, as shown in FIG. 4.

Figure 7:
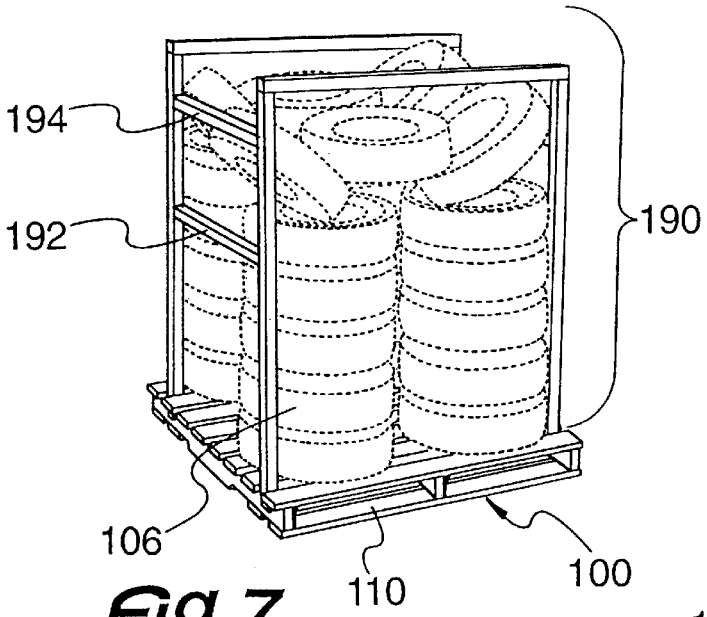
FIG. 7 depicts a side view of ladder frame 200 for the tire storage rack 100.

Furthermore, FIG. 7 with ladder frame of additional support assembly 190 provides improved storage adds an extra bar above the by including additional support assembly 190. Support assembly 190 includes a bottom support bar 192 closest to pallet 110. Above bottom support bar 192 is middle support bar 194. Above middle support bar 194 is top brace 196. Yet, the spring like motion strengthens the hold of the ladder assembly 190 on the pallet 110 and also eliminates the necessity for nailing as in H-shaped frame 150, above cited.

In fact up to eight truck tires may be stored thereon, while up to 56 automobile tire may be stored thereon. Thus, a storage unit interchangeable between truck tires and automobile tires is provided. More efficient use of warehouse space is achieved.

Figure 8:
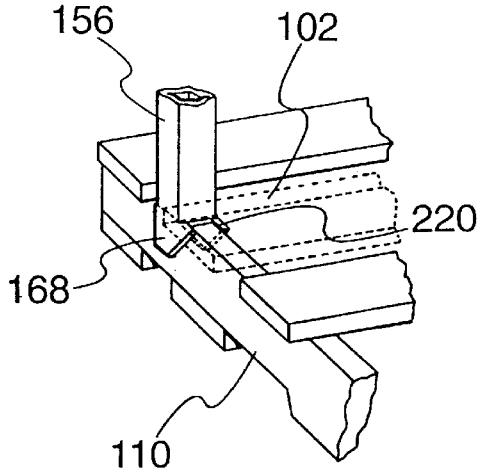
FIGS. 8 and 9 depict a perspective view and a side view of lever foot 168 with protrusion edge 220 for storage rack 100 of this invention.
Figure 9:
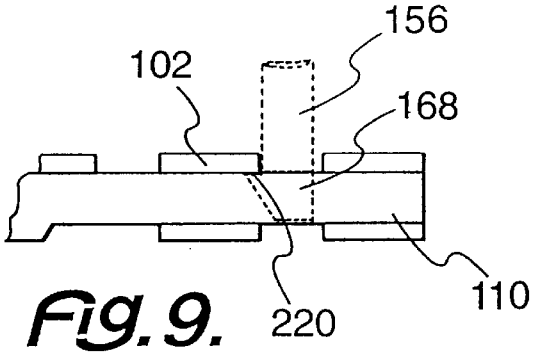

With FIG. 8 and FIG. 9, lever foot 168 has a protrusion edge 220. Protrusion edge 220 for storage rack 100 of this invention fits under a board 102 of pallet 110. This structure combined with the spring load aspects of ladder frame 190 and H-shaped frame 150 provides the strong hold on the pallet 110.

This great advantage in storage makes better use of warehouse space and permits more efficient use of track space. With the yoke foot 160 and the arrangement of either the H-shaped frame 150 or the barred frame 120, it is more feasible to stack pallets on top of each other. The H-shaped frame 150 or the barred frame 120 permits such stacking in a more efficient manner as opposed to the standard difficulty in stacking the X-shaped frame or other tires of the prior art.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A tire storage rack adapted to store a larger number of tires in a lesser amount of floor space comprising:

(a) a frame assembly being removably mounted on a pallet;

(b) the frame assembly having a gripping member adapted to receive the pallet and lock the frame assembly thereon;

(c) the frame assembly being adapted to receive a plurality of tires to rest on the pallet;

(d) the frame assembly having a first H-shaped frame and a second H-shaped frame;

(e) the first H-shaped frame and the second H-shaped frame having at least one cap cross bar connecting therebetween;

(f) the at least one cap cross bar being oppositely disposed from the gripping member;

(g) the at least one cap cross bar being in a female to male relationship with both the first H-shaped frame and the second H-shaped frame;

(h) the gripping member being a U-shaped member adapted to receive the pallet;

(i) the first H-shaped frame and the second H-shaped frame each having a first tall arm and a second tall arm;

(j) a brace connecting the first tall arm to the second tall arm;

(k) the U-shaped member being at an end of each of the first tall arm and the second tall arm;

(l) the U-shaped member being below the brace;

(m) the brace permitting a temporary widening of the separation between the first tall arm and the second tall arm in order to secure the frame assembly to the pallet;

(n) the at least one cap cross bar including a first bar and a second bar;

(o) the first bar connecting the first H-shaped frame to the second H-shaped frame;

(p) the second bar connecting the first H-shaped frame to the second H-shaped frame;

(q) the first bar being substantially parallel to the second bar;

(r) a lever foot protruding from the U-shaped member as support for securing the frame assembly to the pallet;

(s) the lever foot being adapted to fit between a pair of adjoining boards forming the pallet; and (t) the frame being a snap fit assembly.

2. A tire storage rack adapted to store a larger number of tires in a lesser amount of floor space comprising:

(a) a frame assembly being removably mounted on a pallet;

(b) the frame assembly having a gripping member adapted to receive the pallet and lock the frame assembly thereon;

(c) the frame assembly being adapted to receive a plurality of tires to rest on the pallet;

(d) the frame assembly having a first ladder frame and a second ladder frame;

(e) the first ladder frame and the second ladder frame having at least one bar connecting therebetween;

(f) the at least one bar being oppositely disposed from the gripping member;

(g) the first ladder frame and the second ladder frame, each having at least two horizontal bars between two vertical bars;

(h) the first ladder frame and the second ladder frame having at least one cap cross bar connecting therebetween;

(i) the at least one cap cross bar being oppositely disposed from the gripping member;

(j) the at least two horizontal bars including a bottom support bar and a lower support bar;

(k) the bottom support bar being closer to the pallet than the lower support bar;

(l) the at least one cap cross bar being a first cross cap bar and a second cross cap bar;

(m) a lever foot protruding from the U-shaped member as support for securing the frame assembly to the pallet;

(n) the lever foot being adapted to fit between a pair of adjoining boards forming the pallet; and (o) the frame being a snap fit assembly.

3. A tire storage rack adapted to store a larger number of tires in a lesser amount of floor space comprising:

(a) a frame assembly being removably mounted on a pallet;

(b) the frame assembly having a gripping member adapted to receive the pallet and lock the frame assembly thereon;

(c) the frame assembly being adapted to receive a plurality of tires to rest on the pallet;

(d) the frame assembly having a first H-shaped frame and a second H-shaped frame;

(e) the gripping member being a U-shaped member;

(f) a lever foot protruding from the U-shaped member as support for securing the frame assembly t o the pallet;

(g) the at least one cap cross bar being oppositely disposed from the gripping member;

(h) the at least one bar being in a female to male relationship with both the first H-shaped frame and the second H-shaped frame;

(i) the gripping member being a U-shaped member adapted to receive the pallet;

(j) the first H-shaped frame and the second H-shaped frame each having a first tall arm and a second tall arm;

(k) a brace connecting the first tall arm to the second tall arm;

(l) the first H-shaped frame and the second H-shaped frame having at least one cap cross bar connecting therebetween;

(m) the U-shaped member being at an end of each of the first tall arm and the second tall arm;

(n) the U-shaped member being below the brace;

(o) the brace permitting a temporary widening of the separation between the first tall arm and the second tall arm in order to secure the frame assembly to the pallet;

(p) the at least one bar being a first bar and a second bar;

(q) the first bar connecting the first H-shaped frame to the second H-shaped frame;

(r) the second bar connecting the first H-shaped frame to the second H-shaped frame;

(s) the first bar being substantially parallel to the second bar;

(t) a lever foot protruding from the U-shaped member as support for securing the frame assembly to the pallet;

(u) the lever foot being adapted to fit between a pair of adjoining boards forming the pallet; and (v) the frame being a snap fit assembly.

4. The tire storage rack of claim 1 further comprising:

(a) the first tall arm and the second tall arm having a square plug at an end oppositely disposed from the yoke;

(b) the first bar and the second bar having a squared aperture at each end thereof; and (c) the squared aperture being adapted to receive the squared plug.

5. The tire storage rack of claim 2 further comprising:

(a) the first tall arm and the second tall arm having a square plug at an end oppositely disposed from the yoke;

(b) the first bar and the second bar having a squared aperture at each end thereof; and (c) the squared aperture being adapted to receive the squared plug.

6. The tire storage rack of claim 3 further comprising:

(a) the first tall arm and the second tall arm having a square plug at an end oppositely disposed from the yoke;

(b) the first bar and the second bar having a squared aperture at each end thereof; and (c) the squared aperture being adapted to receive the squared plug.

7. The tire storage rack of claim 3 further comprising:

(a) the first tall arm and the second tall arm having a square plug at an end oppositely disposed from the yoke;

(b) the first bar and the second bar having a squared aperture at each end thereof; and (c) the squared aperture being adapted to receive the squared plug.

* * * * *